US006709289B2

(12) United States Patent
Huber et al.

(10) Patent No.: US 6,709,289 B2
(45) Date of Patent: Mar. 23, 2004

(54) ELECTRICAL PLUG CONNECTOR

(75) Inventors: Cornel Walter Huber, Gossau (CH); Patrick Lelew, St. Nicolas de Macherin (FR)

(73) Assignees: Huber & Suhner AG, Herisau (CH); Radiall, Voreppe (FR)

( * ) Notice: Subject to any disclaimer, the term of this patent is extended or adjusted under 35 U.S.C. 154(b) by 0 days.

(21) Appl. No.: 10/367,370

(22) Filed: Feb. 13, 2003

(65) Prior Publication Data

US 2003/0153210 A1 Aug. 14, 2003

(30) Foreign Application Priority Data

Feb. 14, 2002 (CH) ..... 0251/02

(51) Int. Cl.[7] ..... H01R 9/05
(52) U.S. Cl. ..... 439/578; 439/352
(58) Field of Search ..... 439/578–585, 439/255, 256, 319, 349, 350, 352, 345

(56) References Cited

U.S. PATENT DOCUMENTS 4,012,105 A * 3/1977 Biddle ..... 439/675
4,017,139 A * 4/1977 Nelson ..... 439/352
4,834,675 A * 5/1989 Samchisen ..... 439/578
4,957,456 A * 9/1990 Olson et al. ..... 439/578
4,963,105 A * 10/1990 Lewis et al. ..... 439/578
5,367,010 A * 11/1994 Gervase et al. ..... 524/260
5,938,465 A * 8/1999 Fox, Sr. ..... 439/350
6,142,812 A * 11/2000 Hwang ..... 439/352
6,379,183 B1 * 4/2002 Ayres et al. ..... 439/578

* cited by examiner

*Primary Examiner*—Ross Gushi
(74) *Attorney, Agent, or Firm*—Tarolli, Sundheim, Covell & Tummino L.L.P.

(57) ABSTRACT

The plug connector has a first connector element (2) and a second connector element (3), which are connected to one another by means of a coupling member (26). The two connector elements (2, 3) form an outer conductor (9) and an inner conductor (10). A contact element (16) which is in the form of a cup spring and exerts an axial force on the connector elements (2, 3) in order to compensate for tolerances is arranged between the two outer conductor parts (11, 12). The contact element (16) forms a closed circular contact surface (A, B) with the respective outer conductor parts (11, 12). The plug connector can be produced at low cost and has low RF characteristics, in particular good passive intermodulation and RF emission.

10 Claims, 2 Drawing Sheets

ELECTRICAL PLUG CONNECTOR

FIELD OF THE INVENTION

The invention relates to an electrical plug connector having a quick-action interlock, having a first connector element and having a second connector element, which are connected to one another by means of a coupling member and form an inner conductor and an outer conductor, with an outer conductor part of the second connector element forming an electrical contact at the end, and with a resilient contact element being arranged between the first connector element and the second connector element.

BACKGROUND OF THE INVENTION

A plug connector of this type has been disclosed in the prior art in WO 00/05785. In this plug connector, the coupling member has a locking ring which detachable connects the two connector elements to one another. An unlocking sleeve is moved axially, in order to release the connection. This raises the locking ring out of an external groove on the second connector element. When the two connector elements are being mated, the locking ring automatically latches into said external groove on the second connector element, and locks it to the other connector element. A sleeve with spring tongues is provided in order to compensate for tolerances in the coupling member, one end of which sleeve is firmly connected to the first connector element, while its other end is latched on the inside to the spring tongues on the second connector element. This plug connector has the particular disadvantage that the physical design is comparatively complex. In particular, said sleeve is comparatively complex to produce and to install.

BRIEF SUMMARY OF THE INVENTION

The invention is based on the object of providing an electrical plug connector of said type, which can be produced mechanically more easily and which nevertheless has good RF characteristics.

For an electrical plug connector of said type, the object is achieved in that the contact element is an annular disc, which rests on the outer conductor parts, between them, with axial stress, and forms circumferential, closed contact surfaces. Trials have shown that the plug connector according to the invention has very good RF characteristics and, in particular, has good passive intermodulation and little RF emission. The production costs are particularly low, with very good RF characteristics if, according to one development of the invention, the contact element is in the form of a cup spring. A contact element such as this can be produced at very low cost. Said RF characteristics are particularly good if, according to one development of the invention, the contact element makes contact with said end face along a circumferential closed circular line. The contact element advantageously makes contact with both connector elements along a closed circumferential circular line. This results in a precisely defined contact with good passive intermodulation and RF emission. A major advantage of the invention is also that axial angle discrepancies between the two connector elements of up to about 1° do not adversely affect the RF contact. The contact is thus distinguished by good bending robustness.

According to one development of the invention, the contact element has an inner collar and is designed such that an axial residual force or residual stress always exists. This ensures that an axial stress is maintained irrespective of the tolerance discrepancies of the coupling member. The contact element is thus designed such that it cannot be flipped over, as is normally possible with cup springs.

One development of the invention provides for the contact element to be mounted on the outside of an insulator. This insulator is preferably arranged in the first connector element, and is arranged between the inner conductor part and the outer conductor part. During assembly, the contact element can easily be pushed onto this outer conductor. Said collar and the assessment on the inner edge of the contact element considerably simplify this assembly process. The contact element is preferably inserted into an external groove on the insulator.

Particularly good RF characteristics are obtained if, according to one development of the invention, the end surface of the outer conductor part of the second connector element is sharpened to form a circumferential linear contact surface. The contact area between the contact element and the second connector element is then always the same, and is precisely defined.

Further advantageous features can be found in the dependent patent claims, in the following description and in the drawing.

BRIEF DESCRIPTION OF THE DRAWINGS

An exemplary embodiment of the invention will be explained in more detail in the following text with reference to the drawing, in which.

DETAILED DESCRIPTION OF THE INVENTION

Figure 1:
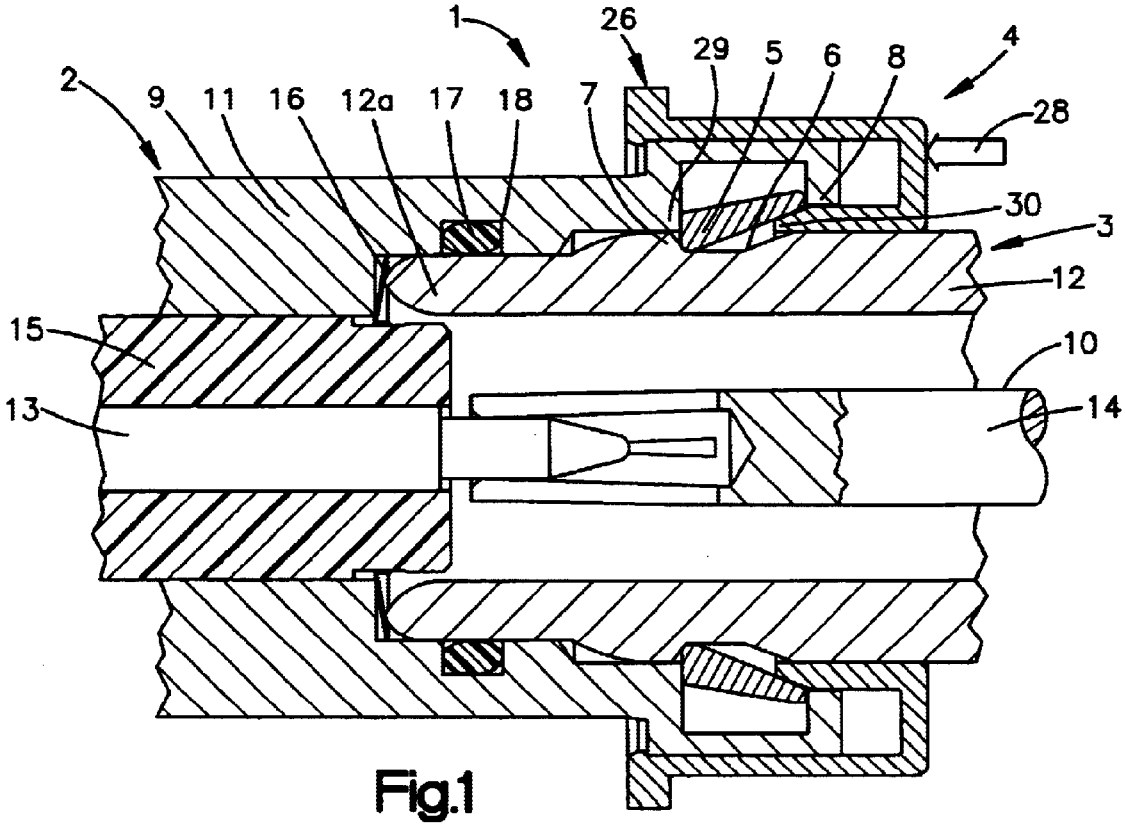
FIG. 1 shows a partial cross section through a plug connector according to the invention.

FIG. 1 shows an electrical plug connector 1 which has a first connector element 2 and a second connector element 3, which respectively form an outer conductor 9 and an inner conductor 10, respectively. The two connector elements 2 and 3 are detachably connected to one another by means of a coupling member 26. In a manner known per se, the coupling member 26 has a locking ring 5, which engages in an external groove 6 on the second connector element 3 and projects on a shoulder 29 of the first connector element 2 and on a holding edge 7. In order to release the lock, a locking sleeve 4 is pushed in the direction of the arrow 28, and thus from right to left, in FIG. 1. By means of a circumferential inner edge 30, the locking ring 5 is pushed out of the external groove 6, thus releasing the lock. When the two connector elements 2 and 3 are being mated, the locking ring 5 automatically latches in the groove 6.

In order to compensate for the tolerance of the coupling member 26 and in order to achieve good RF characteristics, a contact element 16 is provided, which is arranged between the outer conductor part 11 of the first connector element 2 and an outer conductor part 12 of the second connector element 3. The contact element 16 forms a cup spring and has a conical annular disc 23 which, at its edge, has a collar 22 which extends axially and whose wall thickness is several times smaller than the width of the annular disc 23. The contact element 16 is composed of a resilient metal, for example of a suitable copper alloy.

Figure 3:
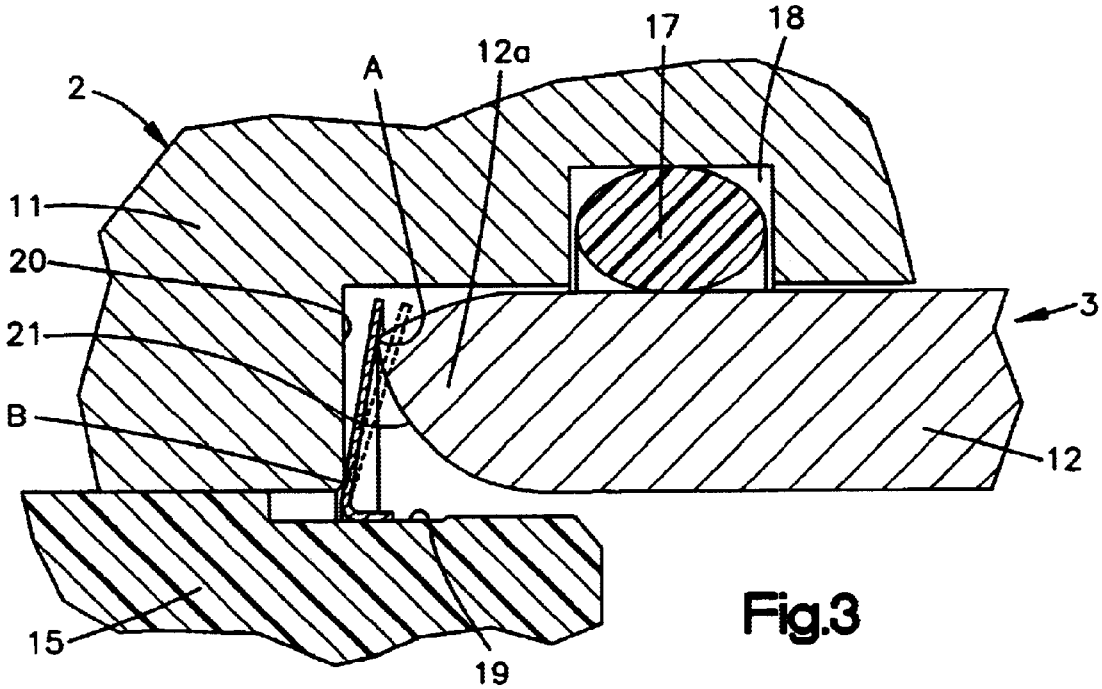
FIG. 3 shows a detail, on an enlarged scale, from FIG. 1.
Figure 4:
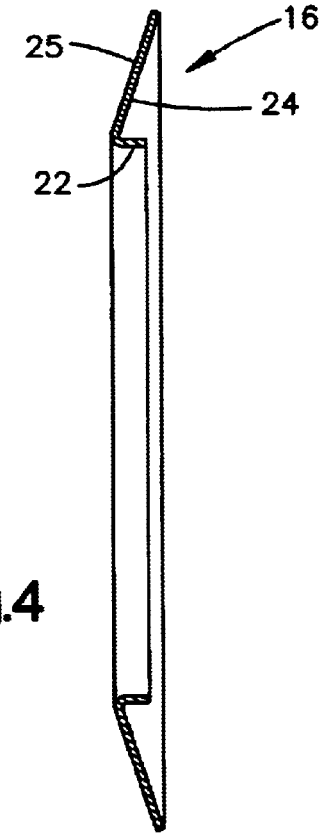
FIG. 4 shows a section through a contact element.
Figure 5:
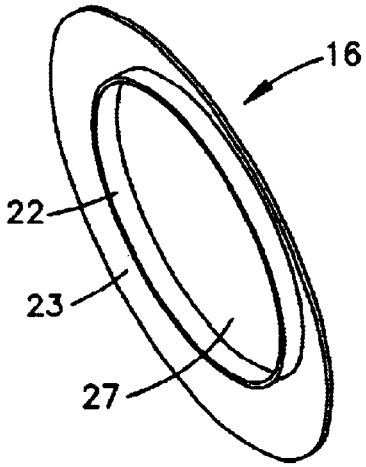
FIG. 5 shows a three-dimensional view of the contact element shown in FIG. 4.

As can be seen particularly clearly in FIG. 3, the contact element 16 is arranged between one end face 21 of the outer conductor part 12 and a contact surface 20 of the outer conductor part 11. With respect to the outer conductor part 12, the contact element 16 forms a circumferential linear and closed contact surface A. With respect to the outer conductor part 11, the contact element 16 likewise forms a closed, circumferential and circular contact surface B. As is shown in FIG. 3, these two surfaces A and B are arranged radially at a distance from one another. The front end 12*a* of the outer conductor part 12 is sharpened, as can be seen, on the end face 21, so that the end surface 21 rests on the contact element 16 only in the area of the closed circular surface A. In the extreme, the contact element 16 can be placed flat against the surface 20. Even in this extreme, a residual force remains and hence, even in this situation, the contact element 16 exerts an axial stress on the two outer conductor parts 11 and 12. As mentioned, the axial stress on the contact element 16 compensates for the tolerance of the coupling member 26.

The contact element 16 is mounted on an insulator 15 which, in a manner known per se, holds an inner conductor part 13 which, as shown in FIG. 1, is connected to an inner conductor part 14 in the form of a spring socket. As is shown in particular in FIG. 3, a circumferential groove 19 is incorporated in the outside of the insulator 15, and the contact element 16 is inserted into this circumferential groove 19. The contact element 16 is thus mounted on the insulator 15, although this is not essential. In order to install the contact element 16, it is pushed onto the insulator 15, which is made considerably easier by the collar 22. The fitting of the contact elements 16 may also be automated.

Figure 2:
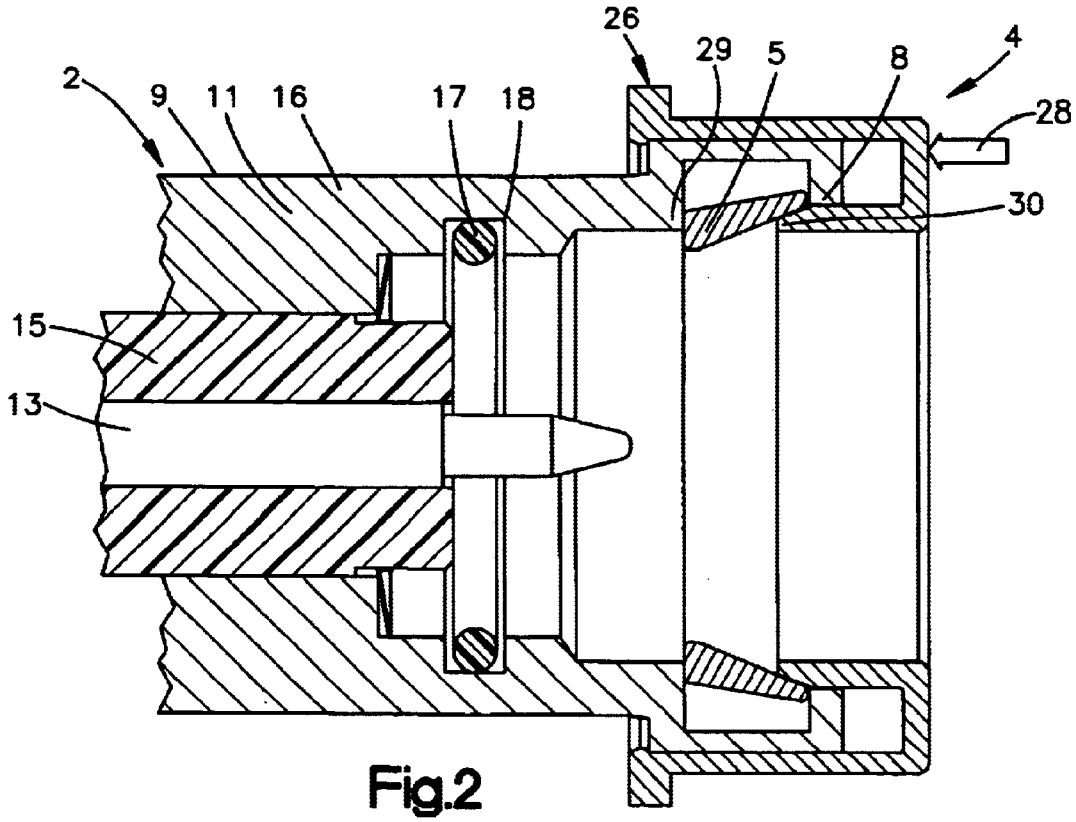
FIG. 2 shows a section through the first connector element.

The two connector elements 2 and 3 are sealed with respect to one another by means of a sealing ring 17, which is inserted into an internal groove 18 in the outer conductor part 11. This sealing ring 17 rests on the outside of the outer conductor part 12, as can be seen. FIG. 2 shows the first connector element 2 with the contact element 16 in the unstressed rest position. When the second connector element 3 is now inserted into the first connector element 2, then the shoulder 7 spreads the locking ring 5 which, in the end, latches into the groove 6. At the same time, the sealing ring 17 is compressed, and the contact element 6 is elastically deformed from the dashed-dotted shape shown in FIG. 3 to the form shown by solid lines. The contact element 16 is thus stressed and exerts an axial force which presses the locking ring 5 against the shoulder 7 and against the holding edge 8. When the connection is released, then the contact element 16 returns to the rest position shown in FIG. 2.

What is claimed is:

1. Electrical plug connector having a quick-action interlock, having a first connector element (2) and having a second connector element (3), which are connected to one another by means of a coupling member (26) and form an inner conductor (10) and an outer conductor (9), with an outer conductor part (12) of the second connector element (3) forming an electrical contact at the end, and with a resilient contact element being arranged between the first connector element (2) and the second connector element (3), characterized in that the contact element (16) is an annular disc, which rests on the outer conductor parts (11, 12), between them, with axial stress, and forms circumferential, closed contact surfaces (A, B).

2. Plug connector according to claim 1, characterized in that the contact element (16) makes contact with the two outer conductor parts (11, 12) along a closed circular line.

3. Plug connector according to claim 1, characterized in that the contact surfaces (A, B) are arranged radially at a distance from one another and essentially parallel to one another.

4. Plug connector according to claim 1, characterized in that the outer conductor part (12) of the second connector part (3) has a sharpened end surface (21) which forms a circumferential linear contact surface (A).

5. Plug connector according to claim 1, characterized in that the coupling member (26) has a locking ring (5), which locks the two connector elements (2, 3) to one another and which can be released by means of an unlocking sleeve (4).

6. Plug connector according to claim 1, characterized in that the outer conductor part (12) of the second connector element (3) is made contact with exclusively on one end surface (21), along a circumferential and closed circular line (A).

7. Plug connector according to claim 1, characterized in that the contact element (16) is in the form of a cup spring.

8. Plug connector according to claim 7, characterized in that the contact element (16) has a conical annular disc (23) which has an inner collar (22) which extends axially and is designed such that an axial residual force always remains.

9. Plug connector according to claim 7, characterized in that the contact element (16) is mounted an insulator (15).

10. Plug connector according to claim 9, characterized in that the contact element (16) is inserted into a circumferential groove (19) on the outside of the insulator (5).

* * * * *

UNITED STATES PATENT AND TRADEMARK OFFICE

CERTIFICATE OF CORRECTION

PATENT NO. : 6,709,289 B2
DATED : March 23, 2004
INVENTOR(S) : Cornel Walter Huber and Patrick Lelew It is certified that error appears in the above-identified patent and that said Letters Patent is hereby corrected as shown below:

Column 4,
Line 43, after "claim" change "7" to -- 1 --.

Signed and Sealed this

Second Day of November, 2004

JON W. DUDAS
*Director of the United States Patent and Trademark Office*